US011773883B2

(12) United States Patent
Florean

(10) Patent No.: US 11,773,883 B2
(45) Date of Patent: Oct. 3, 2023

(54) HYDRAULIC CIRCUIT EQUIPPED WITH A SYSTEM FOR CONTROLLING A HYDRAULIC COMPONENT

(71) Applicant: Robert Bosch GmbH, Stuttgart (DE)

(72) Inventor: Gilles Florean, Lyons (FR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/930,976

(22) Filed: Sep. 9, 2022

(65) Prior Publication Data

US 2023/0117627 A1 Apr. 20, 2023

(30) Foreign Application Priority Data

Oct. 15, 2021 (FR) ..... 2110974

(51) Int. Cl.
*F15B 21/045* (2019.01)
*F15B 13/04* (2006.01)

(52) U.S. Cl.
CPC ..... *F15B 21/045* (2013.01); *F15B 13/0402* (2013.01)

(58) Field of Classification Search
CPC ..... F15B 9/09; F15B 21/082; F15B 20/007; F15B 21/087; F15B 21/034
See application file for complete search history.

(56) References Cited

FOREIGN PATENT DOCUMENTS

CN 204057291 U * 12/2014

OTHER PUBLICATIONS

Translation of CN204057291 provided merged with Foreign Reference (2023).*

* cited by examiner

*Primary Examiner* — Kenneth Bomberg
*Assistant Examiner* — Daniel S Collins
(74) *Attorney, Agent, or Firm* — Maginot, Moore & Beck LLP

(57) ABSTRACT

A hydraulic circuit includes a pump connected to a tank for supplying hydraulic liquid under pressure to a component via a directional control slide valve provided with a feed port connected to an inlet of the component and with a return port connected to an outlet of the component. The hydraulic circuit further includes a pressure limiter connected to the inlet of the component and the tank, and a feed control system for the hydraulic component including a pressure sensor installed upstream of the hydraulic component downstream of the feed port for supplying information about the pressure of the hydraulic liquid and a setpoint pressure. The feed control system further including an actuator for controlling the movement of the directional control slide valve, and a control unit for generating a control signal for the actuator based on information about the pressure measured at the feed port.

4 Claims, 6 Drawing Sheets

HYDRAULIC CIRCUIT EQUIPPED WITH A SYSTEM FOR CONTROLLING A HYDRAULIC COMPONENT

This application claims priority under 35 U.S.C. § 119 to patent application no. FR 2110974, filed on Oct. 15, 2021 in France, the disclosure of which is incorporated herein by reference in its entirety.

The disclosure relates to a hydraulic circuit comprising a pump connected to a tank and supplying the hydraulic liquid at a set pressure to a component via a directional control slide valve provided with a distribution port connected to the inlet of the component and with a decompression port connected to the outlet of the component, and also a pressure limiter connected to the inlet of the component.

BACKGROUND

Multiple systems for controlling hydraulic components with which a hydraulic machine, such as a public works machine, is equipped are already known.

Thus, FIG. 5A shows a system for controlling a hydraulic component 7 by way of an operator actuating its control lever or control member 1. In this instance, the hydraulic component (also referred to as "function") 7 is a motor incorporated in a hydraulic circuit fed by a pump 20 that draws liquid from a tank 21 receiving the hydraulic return liquid from the circuit. The circuit passes through a directional control slide valve 2*a* having a distribution port 3 and a decompression port 4. The cross section of the distribution port 3 follows a distribution law C3 and that of the decompression port 4 follows a decompression law C4. FIG. 5B these laws will be set out below.

The hydraulic circuit 100 is protected upstream of the slide valve 2*a* by a main pressure limiter 9 connected to the tank 21, which limits the pressure of the hydraulic liquid supplied by the pump 20 to a safe pressure, for example 200 bar.

In the circuit itself, the hydraulic component 7 is protected against overpressures by a secondary pressure limiter 6 between the inlet and the outlet of the hydraulic component 7, downstream of the directional control slide valve 2*a*. The secondary limiter 6 is connected directly to the tank 21.

In the event of overpressure causing the secondary limiter 6 to open, the flow that has come from the feed port 3 is discharged directly into the tank 21 without the flow rate being modified for as long as the operator does not modify the flow rate request via their control member 1 which acts directly on the directional control slide valve 2*a*.

During normal operation, the operator generally actuates the lever 1 to its maximum travel. If the instrument 7 becomes blocked during operation, all of the feed flow is discharged by the pressure limiter 6 and directly returned to the tank 21.

By way of example, in the case of a pressure of 100 bar and a flow rate of 60 l/minute, this corresponds to a drop of 10 kW.

Specifically, it is often not until a few seconds after the blockage occurs that the operator reacts and releases the lever so that it returns to the neutral position, and completely closes the feed port 3.

The case set out above is that of a non-reversible hydraulic motor 7, of which the inlet is always fed via the port 3 and the decompression takes the return path via the port 4.

In the case of a reversible motor, the inlet and the return of the motor are swapped over for movement in the opposite direction; the cross sections of the ports then change in accordance with curves symmetrical to those of FIG. 5B, by symmetry about the axis Y representing the cross sections of the ports; the axis X of the travel of the slide valve is oriented in the negative direction.

FIGS. 6A, 6B show the case of a component constituted by a double-acting ram 7A, formed by a cylindrical enclosure subdivided into two chambers for the piston: —one 71 of the chambers is delimited between the piston and the end wall of the cylinder, —the other chamber 72 is delimited between the piston, the rod of the ram and the other end wall.

The variation of the volume of the two chambers 71,72 is different since the cross section of the chamber through which the piston rod passes is reduced by the cross section of this rod.

The operation of the ram is shown by the two FIGS. 6A, 6B, corresponding to a ram fed on the end-wall side and to a ram fed on the rod side, respectively; the curves of change of the ports (3*a*, 4*a*), (3*b*, 4*b*) are shown in the graphs of FIG. 7.

The feed curve C3*a* for the circuit according to FIG. 6A is below the return curve C4*a*, this manifesting itself in the pressure curve CPa.

The feed curve C3*b* of the circuit according to FIG. 6B is above the return curve C4*b*, this manifesting itself in a stable and weak pressure curve CPb for the pressure at the inlet of the ram in this position. The mode of operation of the ram whereby it is fed is switched over to operation in the opposite direction with the ram fed in accordance with FIG. 6B by passing the slide valve through the position 0 to then have ports 3*b*, 4*b* which change in accordance with the curves C3*b*, C4*b*.

In the feed according to FIG. 6A, the pressure at the inlet varies in accordance with the curve CPa and, in the case of the feed of FIG. 6B, the pressure CPb is established at a weak, practically constant level.

The ports (3*a*, 4*a*) and (3*b* and 4*b*) are pairs of separate ports in the slide valve 2*a*; these ports are connected respectively to the chambers 71, 72 via the ports 3*a*, 4*a* and to the chambers 72, 71 in reverse order via the ports 3*b*, 4*b*.

In the two operating modes, in the event of jamming of the ram 7 (7*a*, 7*b*), the secondary limiter 6 intervenes, with consequences similar to those of the circuit of FIG. 5A.

Described in more detail: the ports 3 and 4 have a cross section 83, 84 that is variable depending on the translatory position of the slide valve 2*a*, so as to set the flow rate Q through each port 3 or 4 in accordance with Bernoulli's principle:

$$Q_i = k_i\sqrt{\Delta P} * S_i(x)$$

In this principle:

Qi: flow rate through the port (i),

ΔP: pressure difference between the pressure supplied by the pump 20 and that of the load represented by the component 7, Si(x): cross section of the port (i) as a function of the translatory position (x) of the directional control slide valve 2*a*, ki: coefficient depending on the machining specifications of the slide valve 2*a*, and (i)=3 or 4.

The cross section Si(x) of the port (i) follows a curve representing the change imposed on the cross section Si as a function of hydraulic imperatives linked to the function (that is to say the operating features of the hydraulic component) as is shown in FIG. 3A for the curves C3 and C4 established for the ports 3 and 4 of the hydraulic circuit of FIG. 4.

The curves are plotted in a coordinate system with origin 0, abscissae (x) and ordinates (y).

The ordinate (y) represents the cross section Si(x) of the port (i) for the (x)-position of the directional control slide valve 2*a*. The origin 0 of this axis X is the position of the directional control slide valve 2*a* in which the cross section Si(x) is zero, that is to say the port is closed.

By way of example: The curve C3 representing the cross section S3 of the feed port 3 starts at the origin 0; it rises slowly first of all and then with a steep gradient in an elongate S-shape to its maximum cross section S3max for the end of travel xM of the directional control slide valve 2. The curve C4 representing the cross section S4 of the return port 4 progresses substantially around a straight line, which is not plotted, from the origin 0 to its maximum cross section S4max for the end of travel xM of the directional control slide valve 2*a*.

The curves C3 and C4 intersect. In the initial phase, the feed cross section S3 is below the return cross section S4; this relationship changes with operating conditions so as to arrive in the zone of maximum operating conditions as far as the end of travel xM.

This known hydraulic system uses the pressure limiter 6, which is a hydromechanical limiter installed in the line connected to the tank. The pressure limiter 6 is set via the preload of its spring, by an adjusting screw or an electro-proportional coil, so as to set the maximum admissible pressure at the inlet of the component 7.

An excess pressure arises in the event of jamming of the hydraulic component 7 for an external reason.

The pressure limiter 6 makes it possible to protect various hydraulic implements having a motor or a ram, such as hydraulic hammers, sweepers, augers or other implements, with which a public works machine is equipped. However, this variety of implements creates more or less troublesome drawbacks.

In general, when it is purchased, a hydraulic machine has basic equipment, such as that of an excavator. This equipment is then supplemented by certain implements to which the setup of the hydraulic circuit is not ideally suited, such that it is then necessary to transform the hydraulic circuit, this entailing drawbacks and costs.

The range of pressure settings is limited and, to install the equipment as indicated above, it is necessary to mechanically modify the installation, for example the value of the spring of the pressure limiter 6.

If a pressure to be set is lower than the pressure of the system, this reduces the performance of the other functions, which will have to work at a temporarily reduced pressure.

For implements requiring high speed, that is to say a substantial flow rate, the hydromechanical limiter 6 must be able to discharge significant flow rates to the tank 21, and do so under high pressure, which is the pressure to which the limiter 6 is set. It is therefore necessary to adapt the sizing of the pressure limiter to suit the power to be output. This hydraulic power lost over several seconds can represent a significant drop.

Moreover, in order to discharge a significant flow rate, the fittings and hoses must have a large diameter, thereby rendering them bulky and difficult to install in an existing hydraulic installation.

Depending on the rotational speed of the drive system of the motorized pump unit feeding the hydraulic installation, it is possible to have parasitic frequencies caused by pressure variations, which variations across the hydraulic ram or motor must be limited. This also requires the modification of the directional control slide valve.

SUMMARY

The object of the disclosure is to overcome the drawbacks of the known systems for controlling components of hydraulic circuits and to realize a hydraulic circuit making it possible to operate the hydraulic component more efficiently whilst still making it easier to fit various hydraulic components on one and the same hydraulic machine, by regulating the working pressure.

To that end, the subject of the disclosure is a system for controlling a hydraulic component, this circuit being characterized in that it comprises a feed control system for the hydraulic component, having a pressure sensor installed upstream of the hydraulic component downstream of the feed port and supplying information about the pressure of the hydraulic liquid, and a setpoint pressure, an actuator controlling the movement of the directional control slide valve, a control unit for generating the control signal for the actuator on the basis of the information about the pressure measured at the feed port, on the basis of the setpoint pressure and on the basis of the request from the operator, and a leakage orifice in the slide valve that creates a leakage towards the tank between the feed port and the component in the initial phase of the travel of the slide valve.

The hydraulic circuit according to the disclosure can be realized or installed very simply by combining, with the known hydraulic circuit, a feed pressure sensor for monitoring this pressure, a leakage port in the directional control slide valve, and a control unit making it possible to manage the operation of the directional control slide valve in accordance with the request from the operator by adapting this request to suit the operating specifications of the various components able to be installed in the hydraulic circuit, by configuring the management and by protecting the circuit against pressure shocks or excessive pressures and by allowing operation without loss of power.

The control system according to the disclosure can be installed very easily on an existing machine via a compact system. The system makes it possible overall to limit the loss of power, to restore the available flow rate, and to work at a weaker pressure, where appropriate, and maintain a high pressure for the other functions. More generally, the control system according to the disclosure makes it possible to regulate the working pressure via the configurable control unit.

According to another advantageous feature, the control unit establishes the difference Ec between the information about the pressure from the sensor and the setpoint pressure to convert this pressure difference into a base signal that varies in steps in the operating zones in accordance with the position of the directional control slide valve, and the hydraulic circuit comprises a weighing means receiving the request signal from the operator and the base signal to emit a control signal equal to the smaller of the two signals, i.e. the request from the operator and the base signal.

The disclosure likewise allows a more complete range of pressure limitation settings and overall makes it possible to ensure the stability of the system in all the operating conditions.

In summary, in this hydraulic circuit according to the disclosure, in the event of overpressure, before it reaches the pressure level that triggers the secondary limiter, the control unit receives the pressure signal and generates the control signal for the directional control slide valve in order to return it to the decompression zone in which the cross section and therefore the feed flow rate are reduced and the pressure can be discharged via the leakage port, which has a cross section slightly greater than or equal to the feed cross section within this operating range.

According to another advantageous feature, the circuits of the feed, decompression and leakage ports of the slide valve are subdivided into zones depending on the displacement position of the slide valve: a closure zone, being the feed closure zone from the end-of-travel position of the slide valve to a start-of-opening position; a decompression zone that follows the closure zone and in which the feed cross section opens up slowly while being smaller than the leakage cross section, the feed cross section S3 and leakage cross section S5 being very much smaller than the decompression cross section; a pressure maintaining zone in which the leakage cross section falls again and drops below the feed cross section; a distribution zone in which the cross section of the leakage orifice intervenes only very weakly; and a zone of full flow rate in which the leakage cross section practically no longer intervenes.

According to another advantageous feature, the control unit has a temperature compensation table which receives the base signal SCo so as to compensate it as a function of the temperature of the hydraulic liquid, this temperature being supplied by the temperature sensor detecting the temperature of the hydraulic liquid in the circuit, the temperature-compensated signal see being applied to the weighing means receiving the request signal DO from the operator and this temperature-compensated signal SCC so as to form the control signal from the smaller of these two signals.

BRIEF DESCRIPTION OF THE DRAWINGS

The disclosure will be described below in more detail with the aid of an embodiment of a hydraulic circuit according to the disclosure, which is shown in the appended drawings in which.

DETAILED DESCRIPTION

Figure 1:
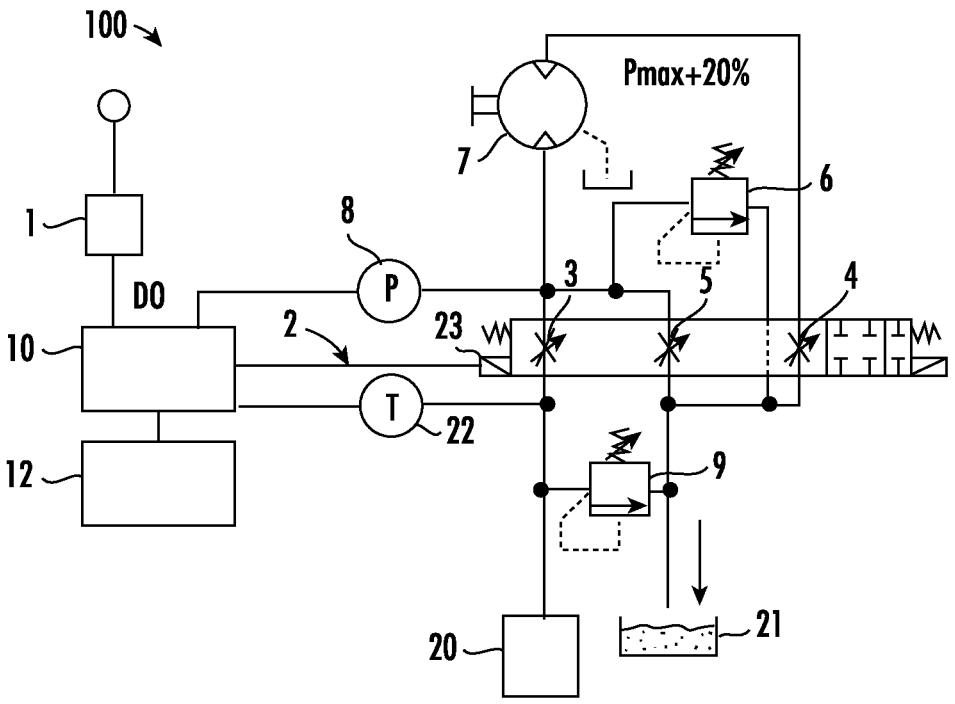
FIG. 1 shows a system for controlling a hydraulic component according to the disclosure.

According to FIG. 1, the subject of the disclosure is a hydraulic circuit 100 fed with hydraulic liquid by a pump 20 (motorized pump) that supplies the hydraulic liquid at a variable pressure, limited by a main pressure limiter 9. The hydraulic circuit 100 comprises a directional control slide valve 2 managing the feed for a hydraulic component 7 according to the request DO from the operator actuating a control member 1, such as a lever, and taking account of imposed parameters.

The hydraulic circuit 100 comprises (i) a branch connecting the pump 20 to the inlet of the hydraulic component 7 through a feed port 3 of the slide valve 2, (ii) a return branch connecting the outlet of the hydraulic component 7 to the tank 21 through the decompression (or return) port 4 of the slide valve 2, and (iii) a bypass, bypassing the inlet of the hydraulic component 7, and leading to the tank 21 via a leakage port 5 of the slide valve 2.

The hydraulic circuit 100 is supplemented by a direct connection between the inlet of the hydraulic component 7 and the tank 21 via a secondary pressure limiter 6, without passing through the return port 4.

The secondary limiter 6 is an important high-pressure safety member for limiting the maximum pressure in the event of failure of the electronic part or by cutting off the electrical power supply. By way of example, the range of settings is from 50 bar to 350 bar. The secondary pressure limiter will be calibrated to 360 bar to avoid overpressures that could damage the ducts, hoses or any other component of the hydraulic system if the directional control slide valve were to remain closed following a control error or via a lack of electrical power.

According to the disclosure, the virtually instantaneous control of the slide valve 2 by the actuator 23 controlled by the unit 10 is independent of the request DO from the operator, that is to say of the position of the actuating member 1.

The leakage port 5 is connected to the feed port 3 upstream of the component 7, thereby making it possible, in the initial phase, to increase the pressure in the hydraulic circuit or to attenuate or smooth out the increase in pressure and also to operate more effectively in the event of a strong increase in pressure; thus, for example, in the event of jamming of the hydraulic component 7, the increase in pressure upstream of the component is immediately detected by the pressure sensor 8 connected to the inlet of the hydraulic component 7; this pressure is processed by the control unit 10, which immediately returns the directional control slide valve 2 to the decompression zone B so as to reduce the feed cross section 83 and therefore the flow rate Q3 arriving at the hydraulic component 7; this weak flow rate is discharged via the leakage port 5 without having to pass through the limiter 6 with a full flow rate and at high pressure. The available flow rate can be fed to another component.

As the features of the hydraulic circuit 100 can depend on the temperature T of the hydraulic liquid, in one variant, to take account of this significant dependence in certain cases, the outlet of the pump 20, downstream of the branching of the primary limiter 9, is provided with a temperature sensor 22.

Figure 2:
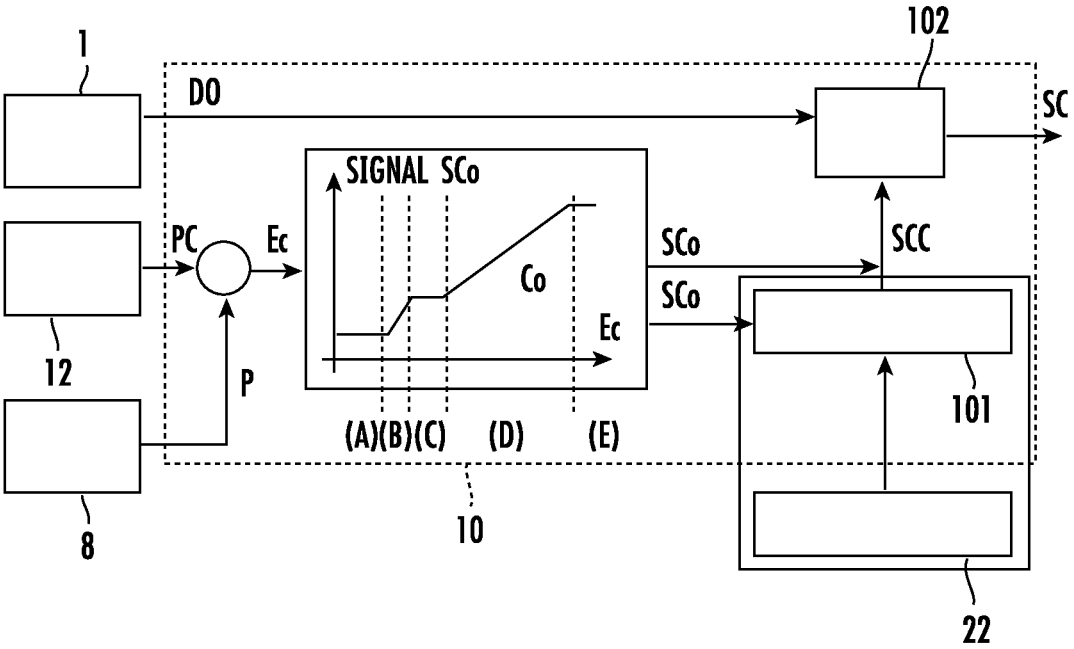
FIG. 2 shows a diagram of the control function of the system.

The directional control slide valve 2 is controlled by a control unit 10 receiving (FIG. 2) (i) the request DO from the operator 1, (ii) the setpoint pressure PC, (iii) the pressure P from the pressure sensor 8, and, as a variant (iv) the temperature T of the hydraulic liquid, which temperature is provided by the sensor 22.

The setpoint pressure PC is a parameter imposed on the operation of the hydraulic circuit 100 to protect the circuit and its components SES and reduce the losses of power caused by returning the liquid at high pressure and with a substantial flow rate, since these losses do not trigger the pressure limiter 6.

The leakage cross section S5 of the leakage port 5 opens up more than that of the feed port 3, thus attenuating the feed flow rate in the feed line of the hydraulic component 7, whether the latter is a motor or a ram.

The pressure maintaining zone C: the leakage cross section S5 decreases, thereby making it possible to implement a controlled repressurization of the feed line of the hydraulic component 7 in order to prepare the conditions for obtaining a movement controlled by the leakage.

At the end of the zone C, the leakage cross section C5 meets the feed curve C3, which continues to rise.

A small leakage cross section S5 is maintained for the leakage port 5 to avoid possible instability, in particular when the system is being excited upon activation of an indicial response (response to a step change).

The slide valve 2 distributes the flow rate in proportion with the pressure drop at the edge of the equivalent port following the opening law of the curve C3.

The distribution zone D: the slide valve 2 distributes the volumetric flow rate in proportion with the pressure drop across the equivalent port of the hydraulic component 7 following the opening law of the curve C4.

The zone of full flow rate E: in this zone, the maximum hydraulic power is reached. The increase in the feed cross section 3 causes the pressure in the load (component 7) to drop. To ensure a stabilized pressure, the return cross section C4 is decreased to obtain a pressure ratio of close to 1 in the case of a hydraulic motor.

At full flow rate travel, the directional control slide valve 2 completely closes the leakage cross section 5 to avoid a needless drop in flow rate.

In the event of jamming of the hydraulic component 7, the increase in the load pressure is immediately detected by the sensor 8 and processed by the control unit 10, which instantaneously returns the slide valve 2 to the zone B to reduce the feed flow rate Q3 via the reduction of the cross section S3 and the compensation via the cross section S5 of the leakage port 5.

Since the measured pressure exceeds the setpoint pressure PC, the difference Ec becomes negative and generates a control signal SCmin, immediately returning the slide valve to the decompression zone B irrespective of the current request DO from the operator.

The feed is thus reduced immediately and the return is carried out via the leakage port 5.

Figure 3A:
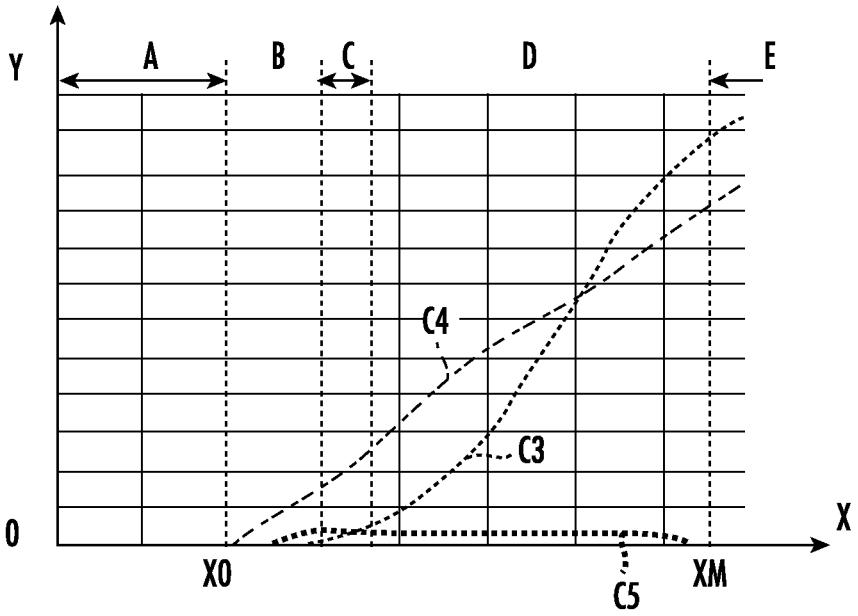
FIG. 3A shows a graph of the curves of the cross sections of the ports of the directional control slide valve.
Figure 3B:
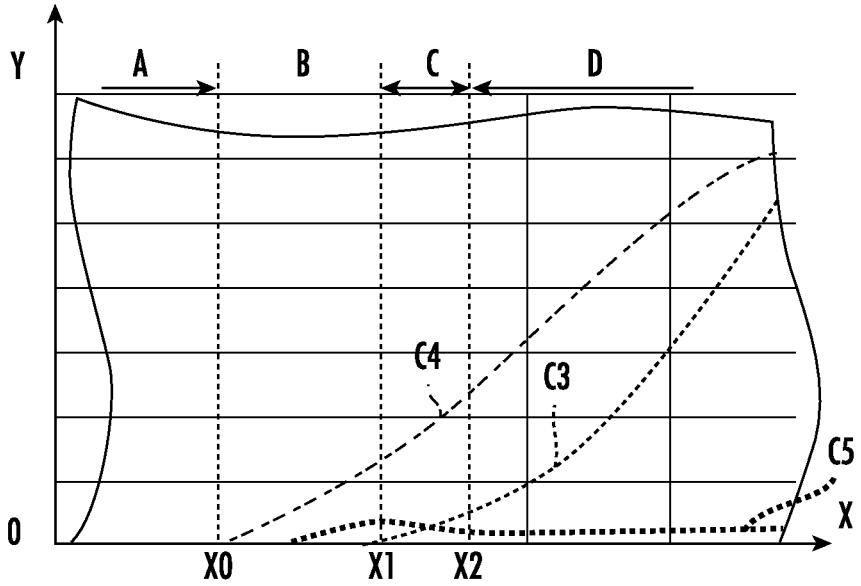
FIG. 3B shows a larger-scale detail of FIG. 3A.
Figure 4:
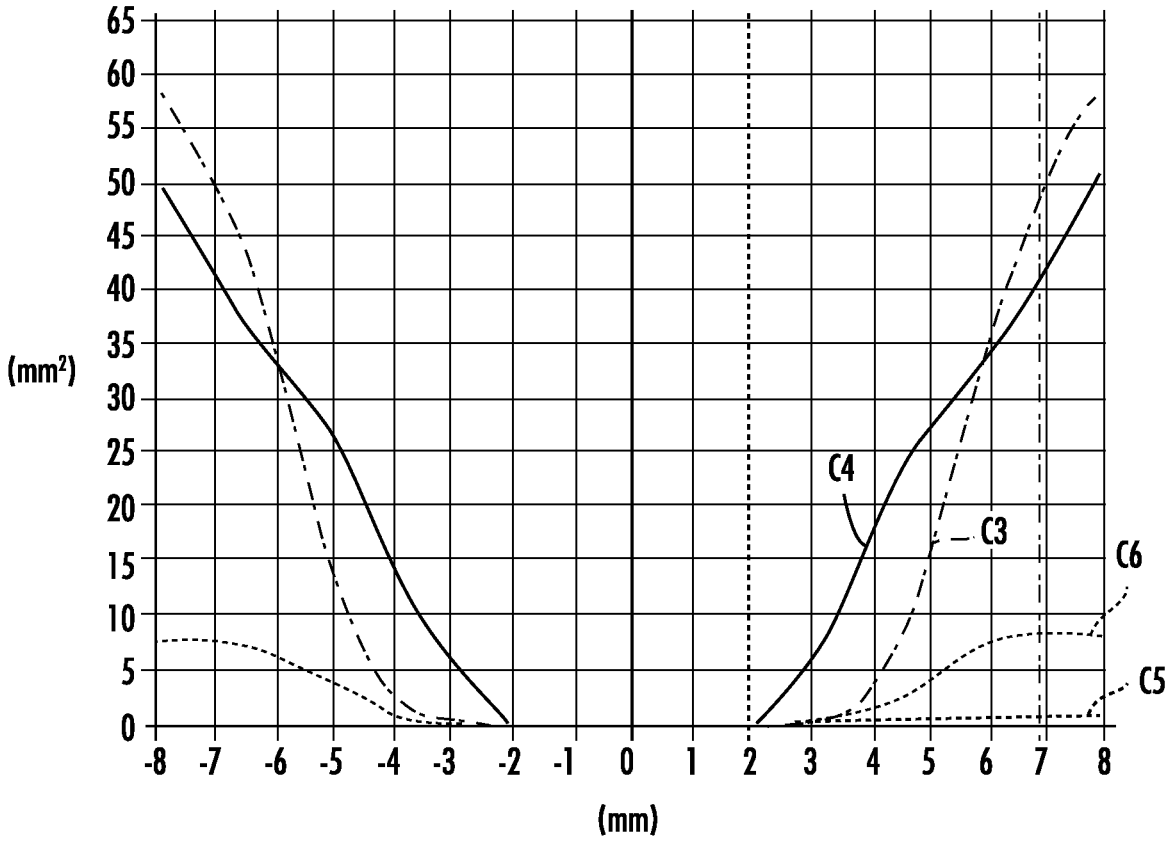
FIG. 4 shows a graph of the curves of the cross section of the ports of the slide valve as a function of a travel of the slide valve for a reversible hydraulic component, such as a hydraulic motor.
Figure 5A:
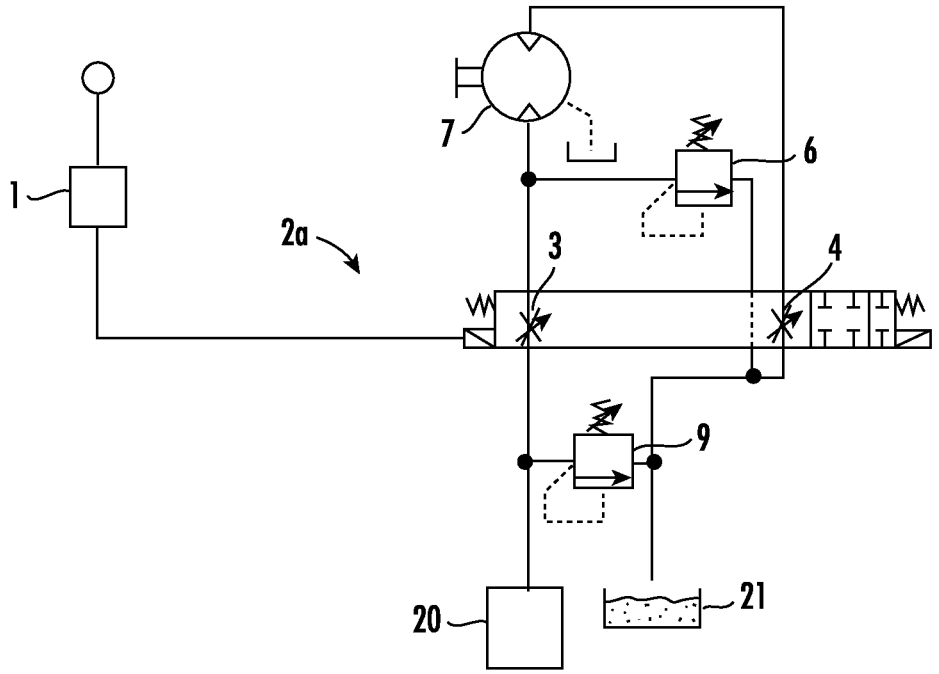
FIG. 5A shows a diagram of a system for controlling a hydraulic component according to the prior art.
Figure 5B:
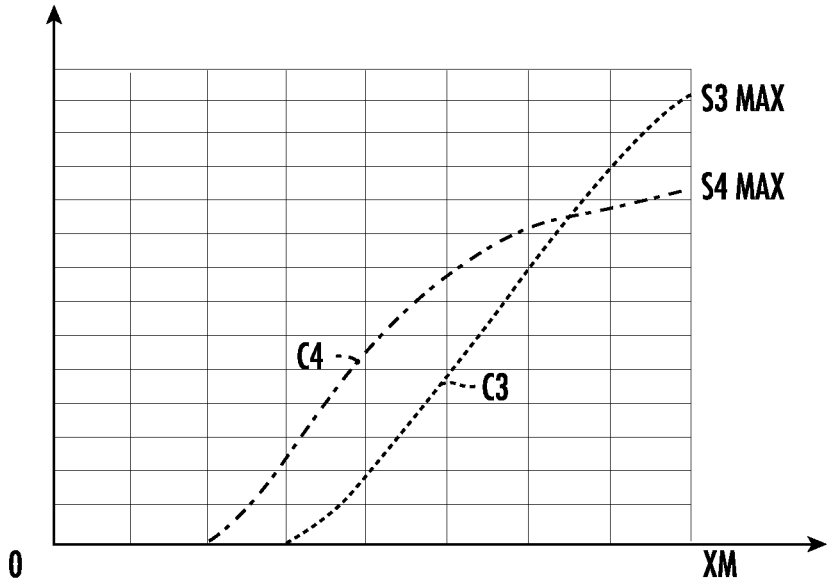
FIG. 5B shows a graph of the curves of the cross section of the ports of the directional control slide valve of the circuit of FIG. 5A.
Figure 6A:
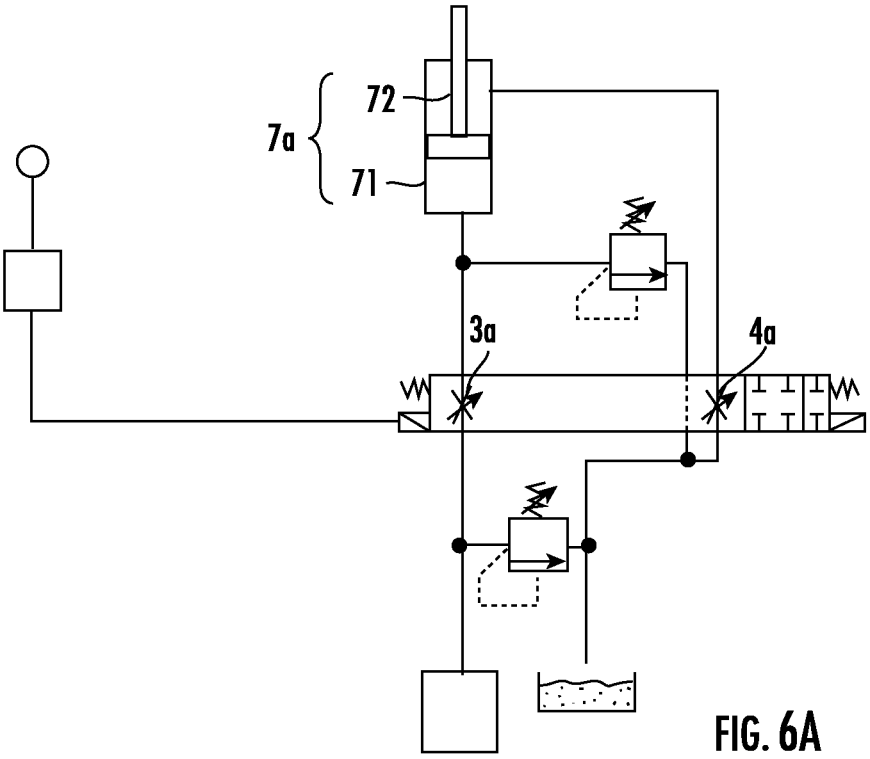
FIG. 6A shows a control diagram for a double-acting hydraulic ram for its first feed position.
Figure 6B:
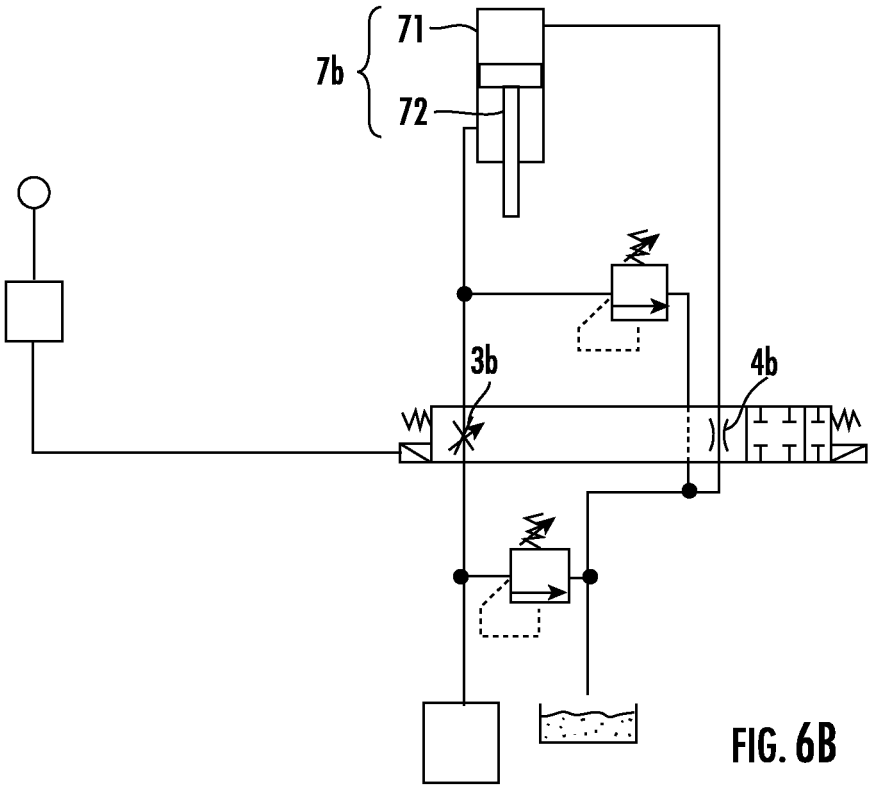
FIG. 6B shows a control diagram for the double-acting ram of FIG. 6A in its second feed position.
Figure 7:
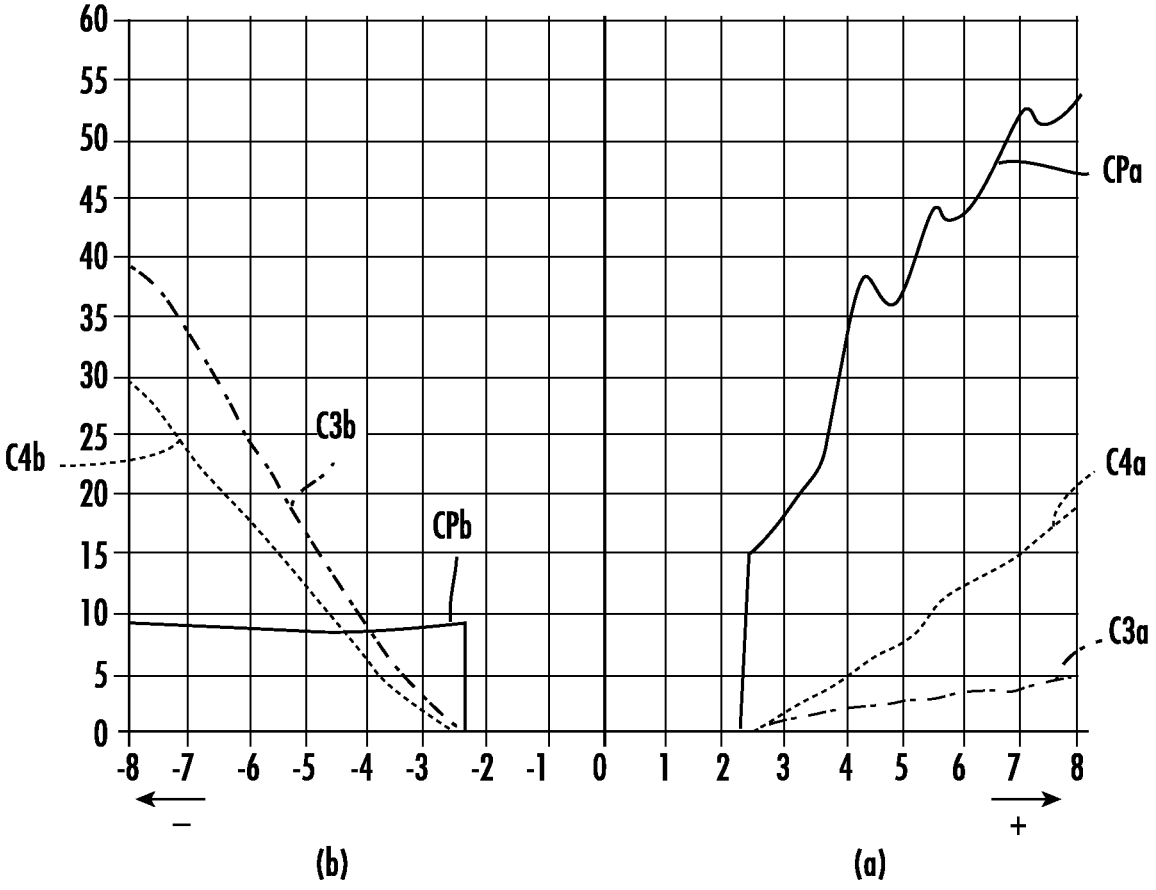
FIG. 7 shows a graph of the curves of the cross section of the ports of the directional control slide valve for the feed of a double-acting ram.

In the case of a hydraulic component 7 constituted by a hydraulic motor, the incoming flow rate is the same as the outgoing flow rate and the curves as set out in FIG. 3A apply.

In the case of a hydraulic ram, the control is done similarly to reduce the feed cross section of the ram in the event of jamming of the instrument associated with the ram.

LIST OF KEY PARTS

100 Hydraulic circuit
1 Control member/lever
2 Directional control slide valve
2*a* Known directional control slide valve
3 Feed port of the component 7
4 Return port of the component 7
5 Leakage port upstream of the component 7
6 Secondary pressure limiter
7 Hydraulic component
7*a,b* Hydraulic ram
8 Pressure sensor at the inlet of the component 7
9 Main pressure limiter
10 Control unit
101 Temperature compensation table
102 Weighing means
20 Feed pump for the hydraulic circuit
21 Hydraulic liquid tank
22 Temperature sensor for the hydraulic liquid at the outlet of the pump 20
23 Actuator of the directional control slide valve 2
P Pressure measured by the sensor 8
PC Setpoint pressure
DO Request from the operator
SCo Base signal
SCC Compensated signal
SC Control signal
Ec Difference between the measured pressure and the setpoint pressure
T Temperature supplied by the sensor 22
A-E Zones of the opening curves for the ports 3, 4, 5
C3 Curve representing the cross section of the feed port
C4 Curve representing the cross section of the decompression port
C5 Curve representing the cross section of the leakage port
C6 Pressure curve
A Closure zone
B Decompression zone
C Pressure maintaining zone
D Distribution zone
E Zone of full flow rate
S3 Feed cross section
S4 Decompression or return cross section
S5 Leakage cross section

What is claimed is:

1. A hydraulic circuit comprising:

a directional control slide valve including (i) a feed port connected to an inlet of a hydraulic component, and (ii) a return port connected to an outlet of the component;

a pump connected to a tank and configured to supply hydraulic liquid under pressure to the component via the directional control slide valve;

a pressure limiter connected to the inlet of the component and connected to the tank;

a feed control system for the component comprising:

a pressure sensor installed upstream of the component and downstream of the feed port, the pressure sensor configured to supply information about a pressure of the hydraulic liquid and a setpoint pressure, an actuator configured to control a movement of the directional control slide valve, a control unit configured to generate a control signal for the actuator based on (i) the information about the pressure measured at the feed port, (ii) the setpoint pressure, and (iii) a request signal from an operator, and a leakage port in the directional control slide valve configured to create a leakage towards the tank between the feed port and the component in an initial phase of travel of the directional control slide valve, wherein the leakage port is located downstream of the directional control slide valve, and is located upstream of the actuator, and wherein the pressure limiter is located downstream of the directional control slide valve, and is located upstream of the actuator.

2. The hydraulic circuit according to claim 1, wherein:

the control unit is configured to establish a pressure difference between (i) the information about the pressure from the pressure sensor, and (ii) the setpoint pressure and to convert the pressure difference into a base signal that varies in steps in operating zones in accordance with a position of the directional control slide valve, and the hydraulic circuit further comprises a weighing device configured to receive the request signal from the operator, and the base signal to emit another control signal equal to a smaller of the request signal and the base signal.

3. The hydraulic circuit according to claim 1, wherein:

curves of cross sections of the feed, return, and leakage ports of the directional control slide valve are subdivided into operating zones depending on a displacement position of the slide valve, and the operating zones include:

a closure zone, being a feed closure zone from an end-of-travel position of the slide valve to a start-of-opening position;

a decompression zone that follows the closure zone and in which a feed cross section opens up slowly while being smaller than a leakage cross section, the feed cross section and the leakage cross section being very much smaller than a decompression cross section;

a pressure maintaining zone in which the leakage cross section falls again and drops below the feed cross section, a distribution zone in which the leakage cross section of the leakage port intervenes only very weakly; and a full flow zone of full flow rate in which the leakage cross section practically no longer intervenes.

4. The hydraulic circuit according to claim 2, wherein:

the control unit has a temperature compensation table which receives the base signal so as to compensate the base signal as a function of a temperature of the hydraulic liquid, which temperature is supplied by a temperature sensor configured to detect the temperature of the hydraulic liquid in the hydraulic circuit, the temperature-compensated signal is applied to the weighing device, and the weighing device is configured to form the control signal as the smaller of the request signal from the operator and the temperature-compensated signal.

* * * * *